US006464538B2

(12) United States Patent
Miyazaki et al.

(10) Patent No.: US 6,464,538 B2
(45) Date of Patent: Oct. 15, 2002

(54) SHIELD CONNECTOR AND TERMINAL CONNECTING DEVICE FOR SHIELDING ELECTRIC WIRE

(75) Inventors: Sho Miyazaki, Nagoya (JP); Hidehiko Iwakawa, Nagoya (JP); Masanori Wakui, Toyota (JP); Keiichi Ito, Toyota (JP); Kazuyuki Shiraki, Toyota (JP)

(73) Assignees: Autonetworks Technologies, Ltd., Aichi (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/799,008

(22) Filed: Mar. 6, 2001

(65) Prior Publication Data

US 2001/0029120 A1 Oct. 11, 2001

(30) Foreign Application Priority Data

Mar. 7, 2000 (JP) ..... 2000-062337
Mar. 7, 2000 (JP) ..... 2000-062372

(51) Int. Cl.[7] ..... H01R 9/03

(52) U.S. Cl. ..... 439/610; 439/65; 439/95; 439/101; 439/386

(58) Field of Search ..... 439/610, 386, 439/608, 609, 95, 97, 98, 101, 65, 300, 460

(56) References Cited

U.S. PATENT DOCUMENTS 4,210,379 A * 7/1980 Vachhani et al. ..... 339/101
4,482,200 A * 11/1984 Willenborg ..... 339/103
5,417,587 A * 5/1995 Katsuda et al. ..... 439/559
5,466,175 A * 11/1995 Onoda ..... 439/610
6,036,543 A * 3/2000 Panis et al. ..... 439/607

FOREIGN PATENT DOCUMENTS

| | | |
|---|---|---|
| DE | 198 48 344 A 1 | 4/1999 |
| JP | 07-222392 A | 8/1995 |
| JP | 10-112958 A | 4/1999 |
| JP | 11-126655 A | 5/1999 |
| JP | 11-235984 A | 8/1999 |

* cited by examiner

*Primary Examiner*—Tho D. Ta
*Assistant Examiner*—Truc Nguyen
(74) *Attorney, Agent, or Firm*—Oliff & Berridge, PLC

(57) ABSTRACT

A connector body 30 to be fixed to a motor case 51 is formed of an aluminum die cast, and is provided, on one of side surfaces thereof, with a cylindrical housing portion 31 for inserting a terminal of a motor cable 10 to be a shielding electric wire. A double enveloping contact 33 is fitted in the housing portion 31 and an eye-ball shaped fixing portion 37 protruded from a front edge thereof is fixed, with a bolt 40, to a fixing base 45 provided integrally on the direct inside of the housing portion 31. A terminal fixture 15 of the terminal of the motor cable 10 is inserted from the housing portion 31 into the connector body 30, and is connected to the other bus bar 50, and a shield shell 21 fitted and attached into a terminal of a shield layer 13 elastically comes in contact with the inner periphery of the contact 33. A reliable electrical connection is obtained between the contact 33 and the housing portion 31 so that a shield function can be displayed effectively.

6 Claims, 11 Drawing Sheets

SHIELD CONNECTOR AND TERMINAL CONNECTING DEVICE FOR SHIELDING ELECTRIC WIRE

BACKGROUND OF THE INVENTION 1. (Field of the Invention)

The present invention relates to a shield connector to be used for accommodating a terminal of a shielding electric wire.

Further, the present invention relates to a device for connecting a terminal of a shielding electric wire to a terminal provided in an apparatus.

2. (Related Art)

The present applicant has developed a shield connector using an aluminum die cast part as a shield countermeasure part in order to mainly enhance a shield performance and has disclosed Japanese Patent Application No. Hei 11-235984 filed earlier, for example. The shield connector is typically shown in FIG. 6.

More specifically, a connector body to be fixed to a shield wall such as an electric apparatus is molded through an aluminum die cast, a cylindrical housing portion 1 is formed in the connector body, and a contact 2 taking the shape of a double enveloping louver is fitted and attached into the housing portion 1. On the other hand, a shield layer 4 comprising a braided wire is exposed to a terminal of a shielding electric wire 3 and is wound upon a terminal of a sheath 5, and furthermore, a terminal fixture 7 is connected to a core 6. The terminal fixture 7 is inserted into the contact 2 so that the shield layer 4 is elastically pressed into the inner periphery of the contact 2. Consequently, the shield layer 4 is conducted to the housing portion 1, and furthermore, a shield wall through the contact 2.

With such a structure, the terminal of the shielding electric wire 3 is wholly surrounded without a clearance by the cylindrical housing portion 1 formed of an aluminum die cast. Therefore, an excellent shield performance can be displayed.

(Problems to be Solved)

In order to display the shield performance in the structure described above, it is necessary to take an electrical connection from the terminal of the shield layer 4 in the shielding electric wire 3 to the contact 2 and the housing portion 1. However, the aluminum die cast tends to form an oxide coat on a surface thereof, and the oxide coat acts as an insulating layer. Consequently, the electrical connection between the contact 2 and the housing portion 1 tends to be unstable.

For this reason, conventionally, the internal surface of the aluminum die cast, that is, the housing portion 1 has been subjected to tinning, thereby enhancing connecting stability. However, since a material is aluminum, it is necessary to carry out the tinning again after copper plating is performed. Consequently, there has been a problem in that a manufacturing cost is increased. Therefore, further improvement has been desired eagerly.

The invention has been completed based on the demand described above and has an object to provide a shield connector capable of obtaining a reliable shield performance at a low cost.

(Related Art)

Further, conventionally, a structure shown in FIG. 13 has been employed in a portion where a terminal of a motor cable comprising a shielding electric wire is connected to a stator terminal of a motor. More specifically, in a terminal of a motor cable 101, a shield cylinder 102 is fitted into a terminal of a shield layer 101A comprising a braided wire and a ground portion 102A is overhung over the outer periphery thereof, and furthermore, a seal ring 102B is fitted into the front end side and a terminal fixture 103 is connected to a core 101B. On the other hand, a fixing hole 105 is opened on a case 104A of a motor 104. The terminal fixture 103 formed on a tip of the motor cable 101 is inserted into the motor case 104A through the fixing hole 105 and is connected to a stator terminal 107 with a bolt 106. In addition, a seal ring 102B of the shield cylinder 102 is tightly fitted in the fixing hole 105 to obtain a waterproofing property. Moreover, the ground portion 102A of the shield cylinder 102 is fixed to the motor case 104A with a bolt 108 to take a ground. Consequently, an electromagnetic shielding structure can be obtained.

(Problems to be Solved)

In other words, conventionally, the terminal of the motor cable 101 has been directly connected to the stator terminal 107 through the motor case 104A. Therefore, a work for connecting the motor cable 101 is to be carried out together with a step of assembling the motor 104 into a vehicle. Consequently, the degree of freedom of the assembling step is restricted. Moreover, also in the case in which the motor cable 101 is to be exchanged for maintenance, it is necessary to disassemble the motor 104 from the vehicle, which is complicated.

The invention has been completed in consideration of the circumstances and has an object to increase the degree of freedom of the assembling step and to enhance maintenance properties.

SUMMARY OF THE INVENTION (Means for Solving the Problems)

In order to achieve the above object, a first aspect of the invention is directed to a shield connector comprising a cylindrical housing portion formed of an aluminum die cast, a contact being fitted and attached into the housing portion and a shield member provided on a terminal of a shielding electric wire being caused to elastically come in contact with the contact, wherein the contact is fixed to the housing portion with a bolt.

A second aspect of the invention is directed to the shield connector according to the first aspect of the invention, wherein the contact is elastically deformable and cylindrical and the shield member of the terminal of the shielding electric wire can be fitted into the contact, and the contact is provided with a fixing portion extended from an edge in an axial direction thereof, the fixing portion being provided with an inserting hole for inserting the bolt to be screwed to a screw hole threaded in the housing portion.

Further, in order to achieve the above object described above, a third aspect of the invention is directed to a terminal connecting device for a shielding electric wire which serves to connect a terminal of a shielding electric wire to a terminal provided in an apparatus, wherein a shield case is fixed to an outer surface of the apparatus and one of ends of a conducting path having the other end connected to the terminal faces an inside of the shield case, the terminal of the shielding electric wire is inserted into an inserting portion formed on a side surface of the shield case so that a shield member provided on the terminal comes in contact with the inserting portion, and a terminal of a core of the shielding electric wire and the other end of the conducting path are coupled to each other on an insulating terminal board provided in the shield case.

A fourth aspect of the invention is directed to the terminal connecting device for a shielding electric wire according to the third aspect of the invention, wherein an operation opening is formed on a side surface corresponding to an outside of a portion in the shield case where the terminal board is provided, and a cover is removably put over the operation opening.

A fifth aspect of the invention is directed to the terminal connecting device for a shielding electric wire according to the third or fourth aspect of the invention, wherein the conducting path is formed of a bus bar.

(Function of the Invention)

<The Invention According to Aspect 1>

The contact is fixed to the housing portion through bolt fastening. The contact is pressed against the housing portion at a high contact pressure. Therefore, a conducting path for the contact—the bolt—the housing portion is constructed so that a reliable electrical connection between the contact and the bolt can be obtained.

More specifically, the plating is required to reduce the cost. Consequently, a reliable shield performance can be obtained.

<The Invention According to Aspect 2>

The contact is fixed by inserting the bolt into the inserting hole of the fixing portion and screwing the bolt into the screw hole of the housing portion. The fixing portion extended from the contact is fixed with the bolt. Therefore, a bolt fastening work can be carried out easily.

<The Invention According to Aspect 3>

The shield case is previously provided in the apparatus, and the other end of the conducting path connected to the terminal in the apparatus faces the inside of the shield case. In the case in which the terminal of the shielding electric wire is to be connected, the terminal of the core is inserted from the inserting portion into the shield case and is thus coupled to the other end of the conducting path over the terminal board. In addition, the shield member is caused to come in contact with the inserting portion to take conduction.

The shielding electric wire can be connected to the terminal in the apparatus later and can be circulated separately from the apparatus. Moreover, the time the work for connecting the shielding electric wire is to be carried out can also be set comparatively freely. Moreover, when the coupling to the conducting path is released in the shield case, the shielding electric wire can be removed simply.

<The Invention According to Aspect 4>

When the cover is removed, the terminal board is opened toward the outside through the operation opening. Therefore, it is possible to easily carry out a work for coupling the terminal of the core of the shielding electric wire to the other end of the conducting path or releasing the coupling.

<The Invention According to Aspect 5>

In the case in which the apparatus serves as an oil chamber, an expensive electric wire excellent in oil resistance is required if the conducting path is an electric wire. If the conducting path is a bus bar, a countermeasure against oil can be taken inexpensively by putting a seal member in a portion where the bus bar penetrates through the shield case.

DETAILED DESCRIPTION OF THE PREFERRED EMBODIMENTS (Mode for Carrying Out the Invention)

An embodiment of the invention will be described below with reference to FIGS. 1 to 5. In the embodiment, a connector to be used for connecting a terminal of a motor cable to a motor of an electric vehicle will be described.

Figure 3:
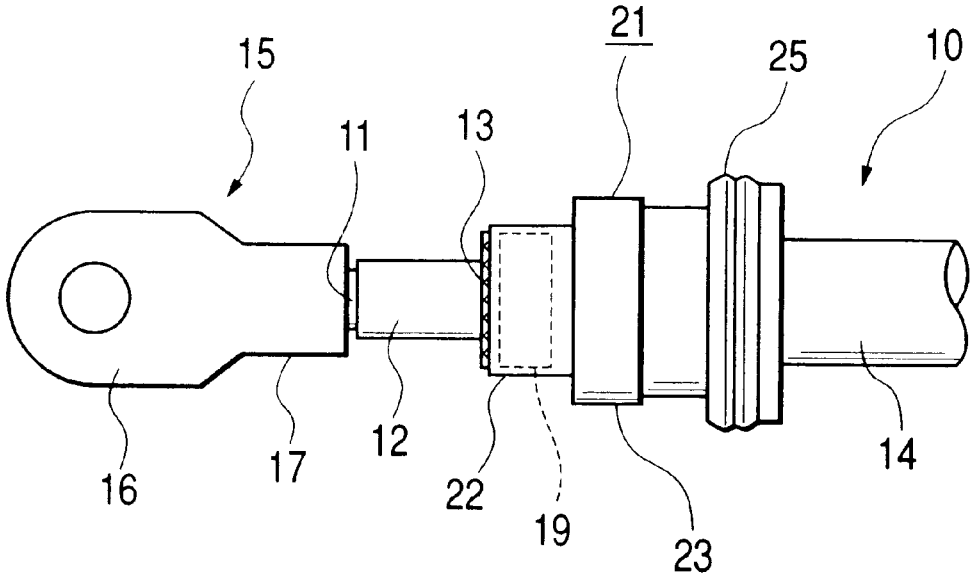
FIG. 3 is a plan view showing a terminal of a motor cable.
Figure 4:
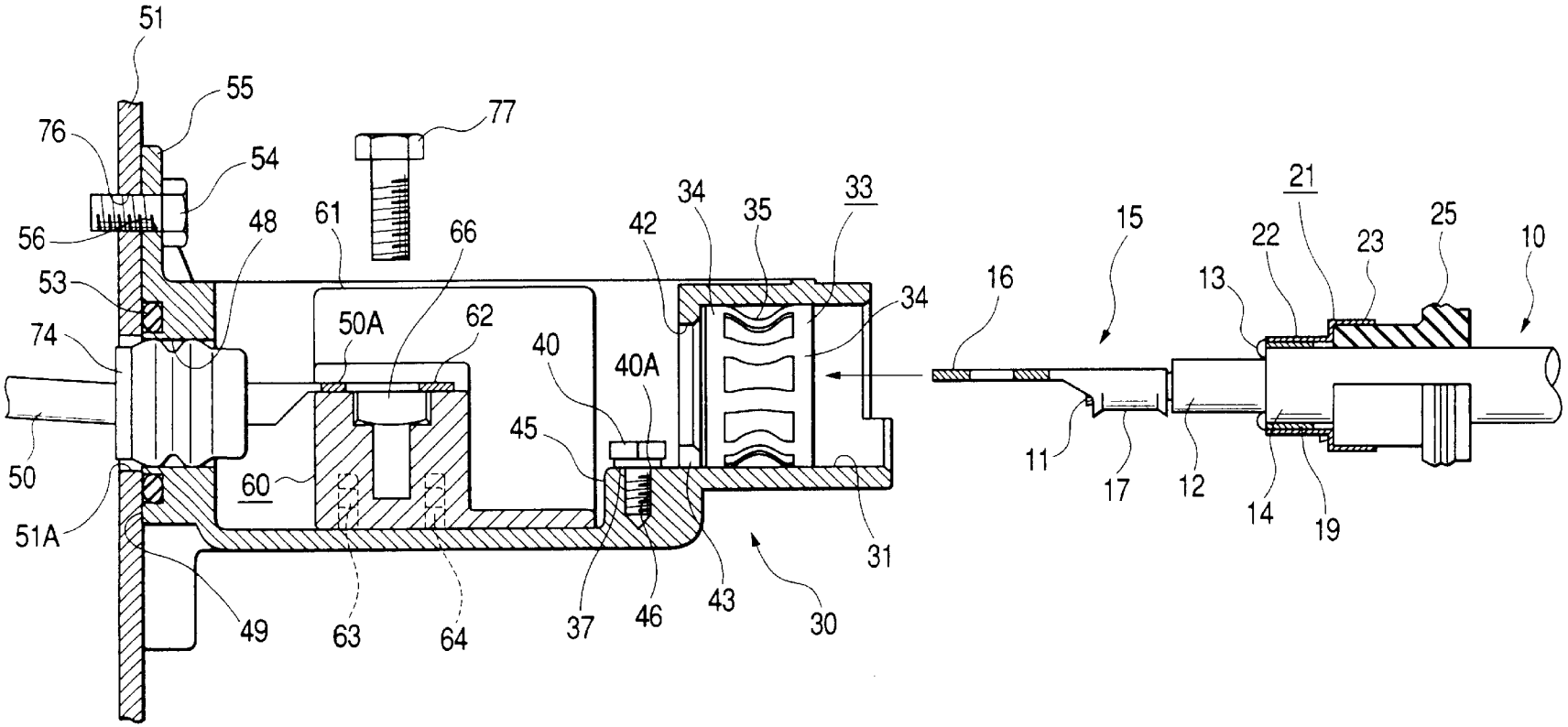
FIG. 4 is a longitudinal sectional view showing an operation for inserting the terminal of the motor cable.

A motor cable 10 is a shielding electric wire, and sequentially comprises a core 11, an internal insulating layer 12, a shield layer 13 formed of a braided wire, and an external coating 14 from the axis side as shown in FIGS. 3 and 4, and has the core 11, the internal insulating layer 12 and the shield layer 13 sequentially exposed at a terminal thereof.

A terminal fixture 15 having an eye-ball shaped connecting portion 16 is fastened to a terminal of the core 11 by caulking a barrel 17. On the other hand, an underlying C ring 19 is fitted in a terminal of the external coating 14 and a terminal of the shield layer 13 is wounded and superposed on the C ring 19, and a cylindrical stepped shield shell 21 having a large diameter on the rear end side is provided, and a small diameter portion 22 thereof is caulked and fastened with the terminal of the wound shield layer 13 interposed together with the C ring 19. Moreover, a waterproof rubber plug 25 is pressed by the large diameter portion 23 and is fitted behind the shield shell 21.

Figure 1:
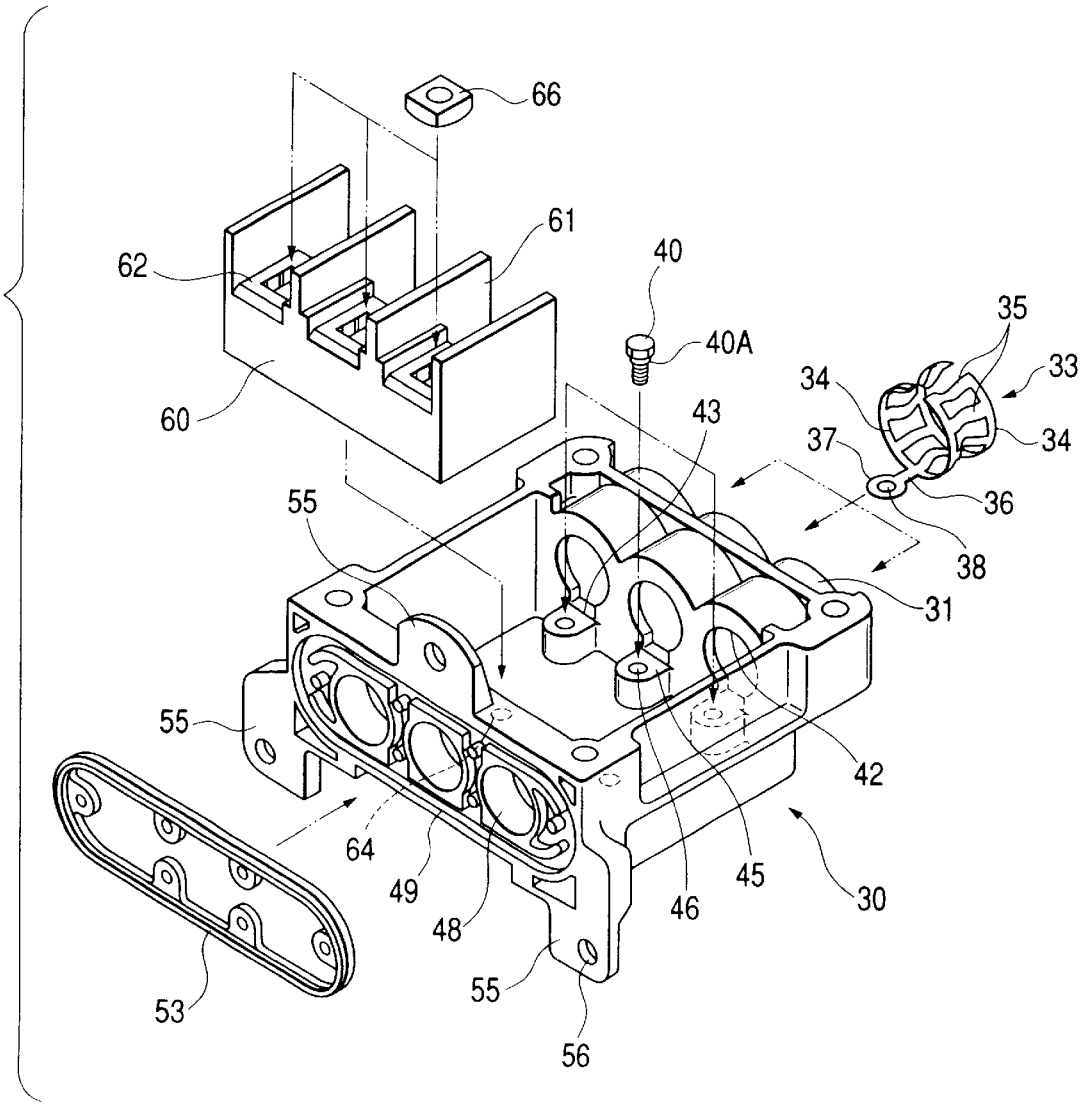
FIG. 1 is an exploded perspective view showing a connector body according to an embodiment of the invention.
Figure 2:
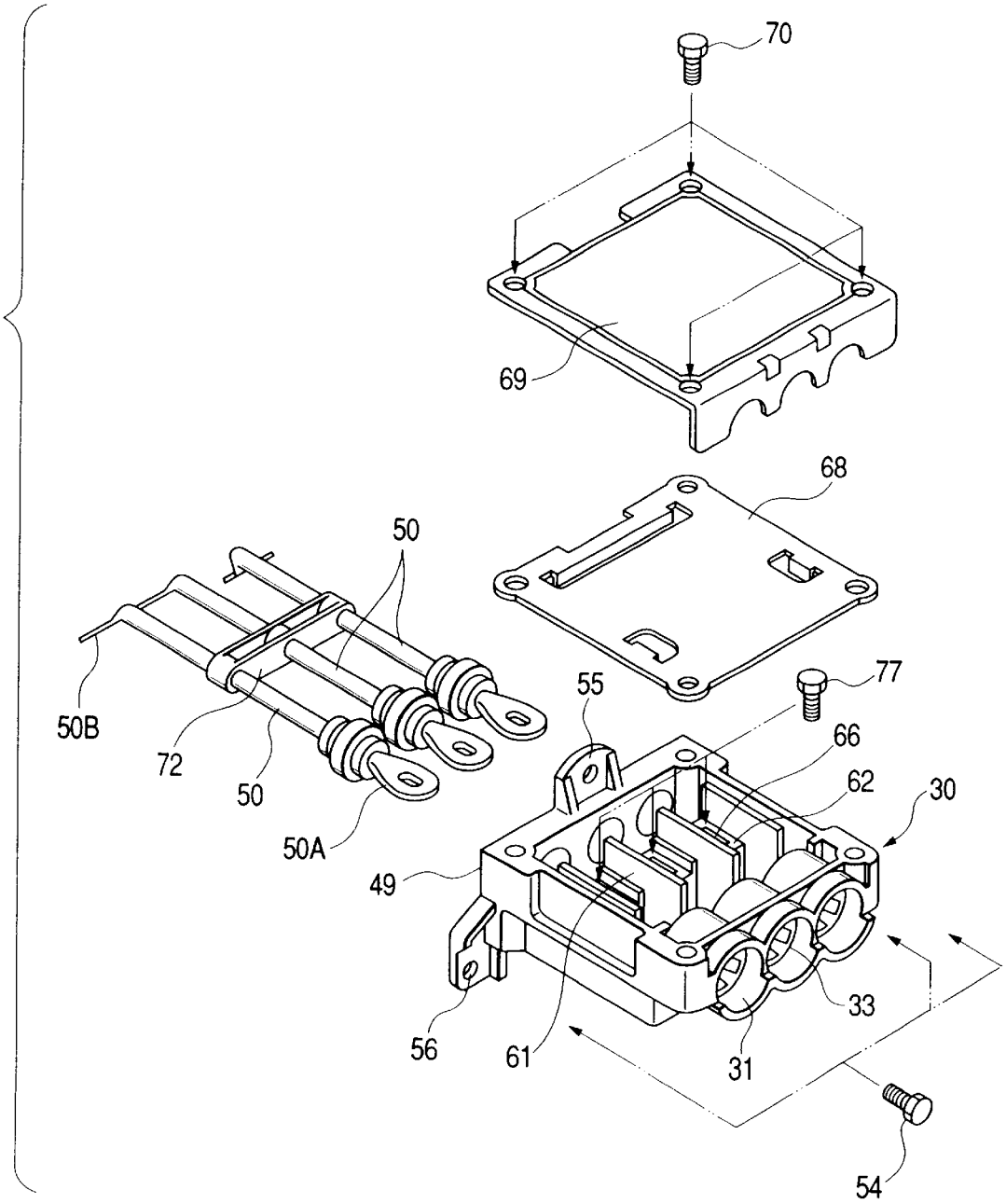
FIG. 2 is an exploded perspective view showing the connecting structure of the connector body and the other bus bar.

As described above, three motor cables 10 subjected to a terminal processing are provided and the terminals thereof are accommodated in a connector body 30. The connector body 30 is formed of an aluminum die cast and wholly takes the shape of a shallow box having an upper surface opened rectangularly as shown in FIGS. 1 and 2.

The connector body 30 has three cylindrical housing portions 31 arranged in a transverse direction on one of four side surfaces thereof, and the terminal fixture 15 of the motor cable 10 is inserted into each of the housing portions 31.

A contact 33 is attached into the housing portions 31, respectively. As shown in FIG. 1, the contact 33 is formed to have a double enveloping shape by providing a plurality of bands 35 between two side members 34 at an interval and turning and bending them to have a cylindrical shape which can be tightly fitted in the housing portion 31, and bulging each of the bands 35 toward the inside.

A neck portion 36 is extended from a front edge (this side of FIG. 1) of the contact 33 in an axial direction and is provided, on a tip thereof, with an eye-ball shaped fixing portion 37 having an inserting hole 38 formed on the center thereof. A bolt 40 can be inserted into the inserting hole 38.

On the other hand, in an internal opening 42 of each of the housing portions 31, a front edge of the contact 33 has a diameter reduced to hit thereon as shown in FIG. 4. A relief trench 43 for fitting and relieving the neck portion 36 of the contact 33 is formed on the peripheral surface at the lower side of the opening 42. Moreover, a fixing base 45 capable of mounting the fixing portion 37 of the contact 33 is formed immediately ahead of each housing portion 31 on almost the same level with the relief trench 43. A screw hole 46 to which the bolt 40 can be screwed is threaded in the upper surface of the fixing base 45.

Three circular inserting portions 48 are formed opposite to each housing portion 31 on a surface opposed to a surface provided with the housing portion 31 in the connector body 30. A bus bar 50 to be connected to a stator terminal (not shown) of the motor can be inserted into each inserting portion 48. A surface 49 on which the inserting portion 48 is formed can be fixed in contact with a motor case 51 (see FIG. 4), and a packing 53 is attached to the back side of the fixing surface 49. In addition, a fixing leg 55 having an inserting hole 56 for a bolt 54 formed thereon is protruded from the central portion of an upper edge and both ends of a lower edge, respectively.

A terminal base 60 formed of a synthetic resin is attached into the connector body 30. Three mounting surfaces 62 are partitioned and formed through a partition wall 61 in the terminal base 60. The terminal base 60 is fixed by pressing a pin 64 erected from the bottom face of the connector body 30 into a fixing hole 63 formed on the lower surface of the terminal base 60 as shown in FIG. 4. At this time, each of the mounting surfaces 62 is positioned between the housing portion 31 and the inserting portion 48 which are opposed to each other. An eye-ball shaped connecting portion 50A formed on one of ends of the bus bar 50 and a connecting portion 16 of the terminal fixture 15 fastened to the terminal of the motor cable 10 can be superposed and mounted on the mounting surface 62, and furthermore, a square nut 66 is fitted in the mounting surface 62.

Furthermore, the opening formed on the upper surface of the connector body 30 is covered with a metallic cover 69 through the packing 68 and four corners of the cover 69 are fastened with a bolt 70.

Subsequently, description will be given to an example of the assembling procedure according to the embodiment.

In the connector body 30, the contact 33 is inserted from the outside into each inserting portion 31, and is caused to hit on the edge of the internal opening 42 and is stopped so that the fixing portion 37 is mounted on the fixing base 45. Next, the bolt 40 having a spring washer 40A is inserted into the inserting hole 38 of the fixing portion 37, and is screwed and fastened to the screw hole 46 provided thereunder. Consequently, the fixing portion 37 is fixed to the fixing base 45 as shown in FIG. 4.

Moreover, the terminal base 60 having the square nut 66 attached to each mounting surface 62 is assembled into the connector body 30, and the packing 53 is attached to the fixing surface 49. Then, each of the connecting portions 50A of the three bus bars 50 arranged and coupled through the coupling member 72 is inserted from the outside into each inserting portion 48, and is mounted on the mounting surface 62 corresponding to the terminal base 60. In addition, a rubber plug 74 provided behind the connecting portion 50A is tightly fitted and attached into the inserting portion 48.

The connector body 30 thus assembled is previously fixed to the motor case 51. More specifically, a fixing hole 51A is opened on the motor case 51 as shown in FIG. 4, the fixing surface 49 is caused to hit on the motor case 51 while the connecting portion 50B provided opposite to the bus bar 50 is inserted into the fixing hole 51A, and the bolt 54 inserted through the inserting holes 56 of the fixing legs 55 provided in three parts is screwed and fastened to a screw hole 76 threaded in a predetermined position around the fixing hole 51A. Consequently, the connector body 30 is fixed to be protruded horizontally with respect to the motor case 51. The connecting portion 50B plunged into the motor case 51 of the bus bar 50 is connected to the stator terminal of the motor.

Figure 5:
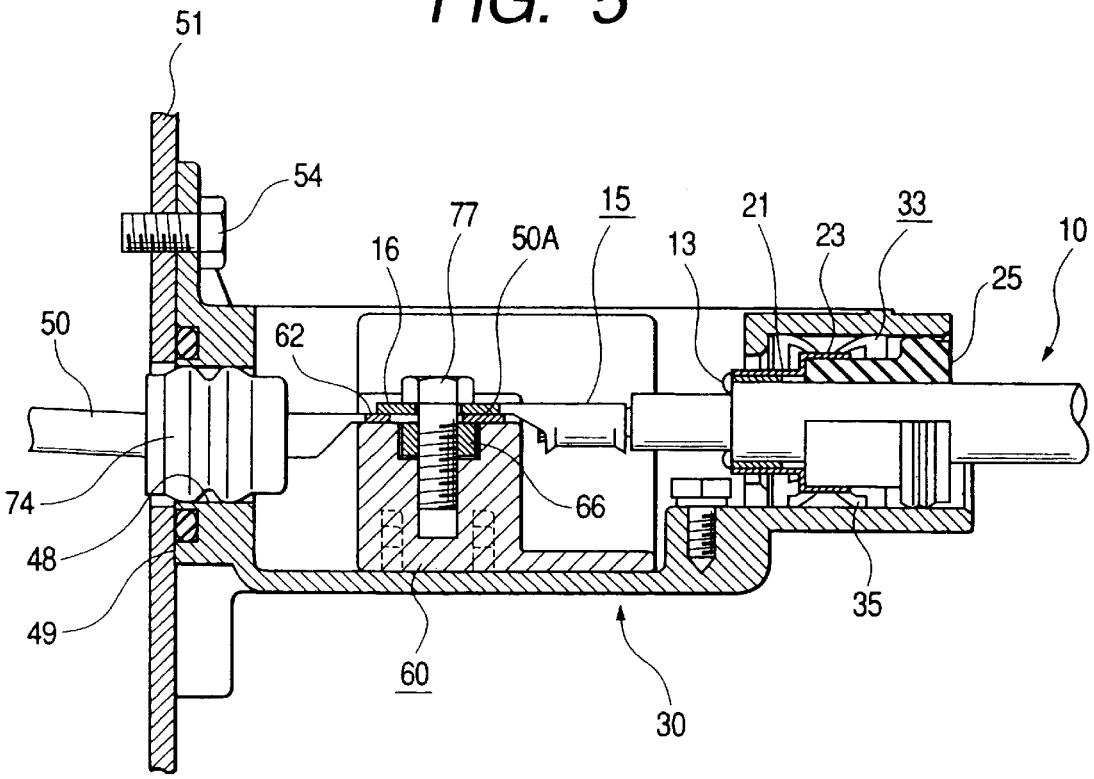
FIG. 5 is a longitudinal sectional view showing a state in which the motor cable and the bus bar are connected to each other.
Figure 6:
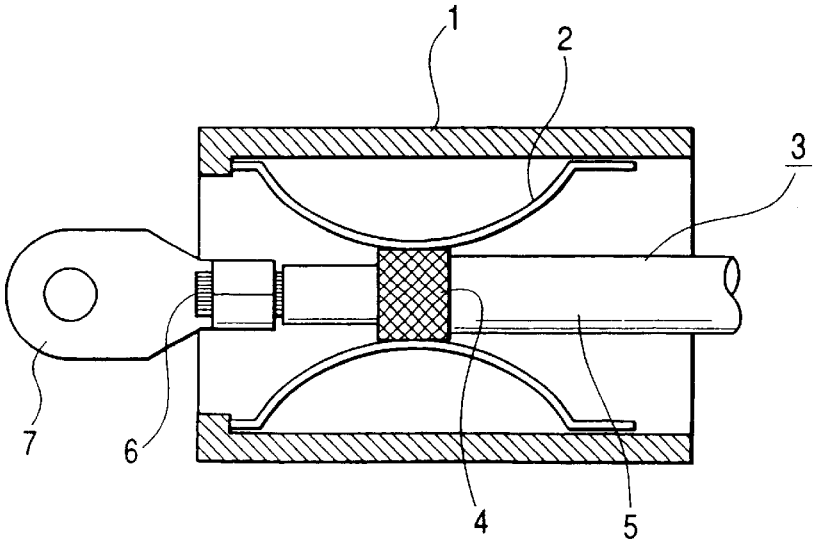
FIG. 6 PRIOR ART
FIG. 6 is a sectional view showing a conventional example.

In such a state, the terminal fixture 15 provided on the terminal of each motor cable 10 is inserted into the corresponding housing portion 31 as shown in an arrow of FIG. 4. The connecting portion 16 of the terminal fixture 15 reaches the mounting surface 62 of the terminal base 60 and is then inserted to be superposed on the connecting portion 50A of the bus bar 50. Then, when the bolt 77 is inserted into the connecting portions 16 and 50A of the terminal fixture 15 and the bus bar 50 to be screwed and fastened to the square nut 66, the terminal fixture 15 and the bus bar 50 corresponding thereto are connected to each other and are fixed to the terminal base 60 as shown in FIG. 5.

At this time, the large diameter portion 23 of the shield shell 21 is simultaneously fitted into the inner peripheral surface bulged in the contact 33 and elastically comes in contact therewith, and moreover, the waterproof rubber plug 25 is tightly fitted and attached into the entry of the housing portion 31.

When the three motor cables 10 are completely fixed, the cover 69 is put over the opening formed on the upper surface of the connector body 30 through the packing 68 and four corners thereof are fastened with the bolt 70 to close the cover 69.

As described above, the terminal of each motor cable 10 is connected to the stator terminal of the corresponding motor through the bus bar 50. At this time, the connector body 30 formed of an aluminum die cast is set in an electrical connection state with the grounded metallic motor case 51, and the periphery from the terminal fixture 15 of the terminal of the motor cable 10 to the bus bar 50 is completely surrounded without a clearance by the housing portion 31, the connector body 30, the cover 69, and furthermore, the motor case 51. Consequently, it is possible to reliably prevent the invasion of a noise into the motor cable 10 or the leakage of the noise.

In the portion where the terminal of the motor cable 10 is to be shielded, the contact 33 is attached into the housing portion 31 formed on the connector body 30 and the shield shell 21 connected to the shield layer 13 in the motor cable 10 is caused to elastically come in contact with the inner peripheral side of the contact 33 as described above. Consequently, the shield layer 13 is electrically connected to the housing portion 31 through the contact 33.

The housing portion 31 is formed of an aluminum die cast and an oxide coat is easily formed on an inner peripheral surface thereof. Therefore, there is a possibility that the oxide coat might function as an insulating layer, resulting in an unstable electrical connecting state between the contact 33 and the housing portion 31.

In the embodiment, the fixing portion 37 is extended from the contact 33 and is fastened and fixed, with the bolt 40, into the fixing base 45 provided integrally with the housing portion 31. Therefore, the fixing portion 37 is pressed against the fixing base 45 at a high contact pressure, and the conducting path for the fixing portion 37 of the contact 33—the bolt 40—the fixing base 45 provided integrally with the housing portion 31 is also maintained. Therefore, a reliable electrical connection between the contact 33 and the housing portion 31 can be obtained. Consequently, a shield performance can be displayed reliably.

In addition, it is not necessary to carry out expensive plating on the housing portion 31 in order to obtain the reliable electrical connection. Consequently, it is possible to contribute to a reduction in a manufacturing cost.

<Other Embodiment>

The invention is not restricted to the embodiment described above with reference to the drawings but the following embodiments are also included in the technical range of the invention, for example. Furthermore, various changes can be made without departing from the scope of the invention.

(1) The structure of the portion where the shield layer of the shielding electric wire is caused to come in contact with the contact attached to the housing portion is not restricted to the embodiment but it is also possible to employ another structure in which a terminal of a folded shield layer is caused to directly come in contact with the contact, for example.

(2) The contact is not restricted to that of the embodiment but any shape or structure can be applied if the contact is attached into the housing portion in a contact state and can elastically come in contact with the shield member of the terminal of the shielding electric wire.

(3) The invention can also be applied to a connector of a wire using a shielding electric wire.

<Third Embodiment>

A third embodiment of the invention will be described with reference to FIGS. 7 to 11. In the embodiment, a portion for connecting a terminal of a motor cable to a motor of an electric vehicle will be described.

Figure 7:
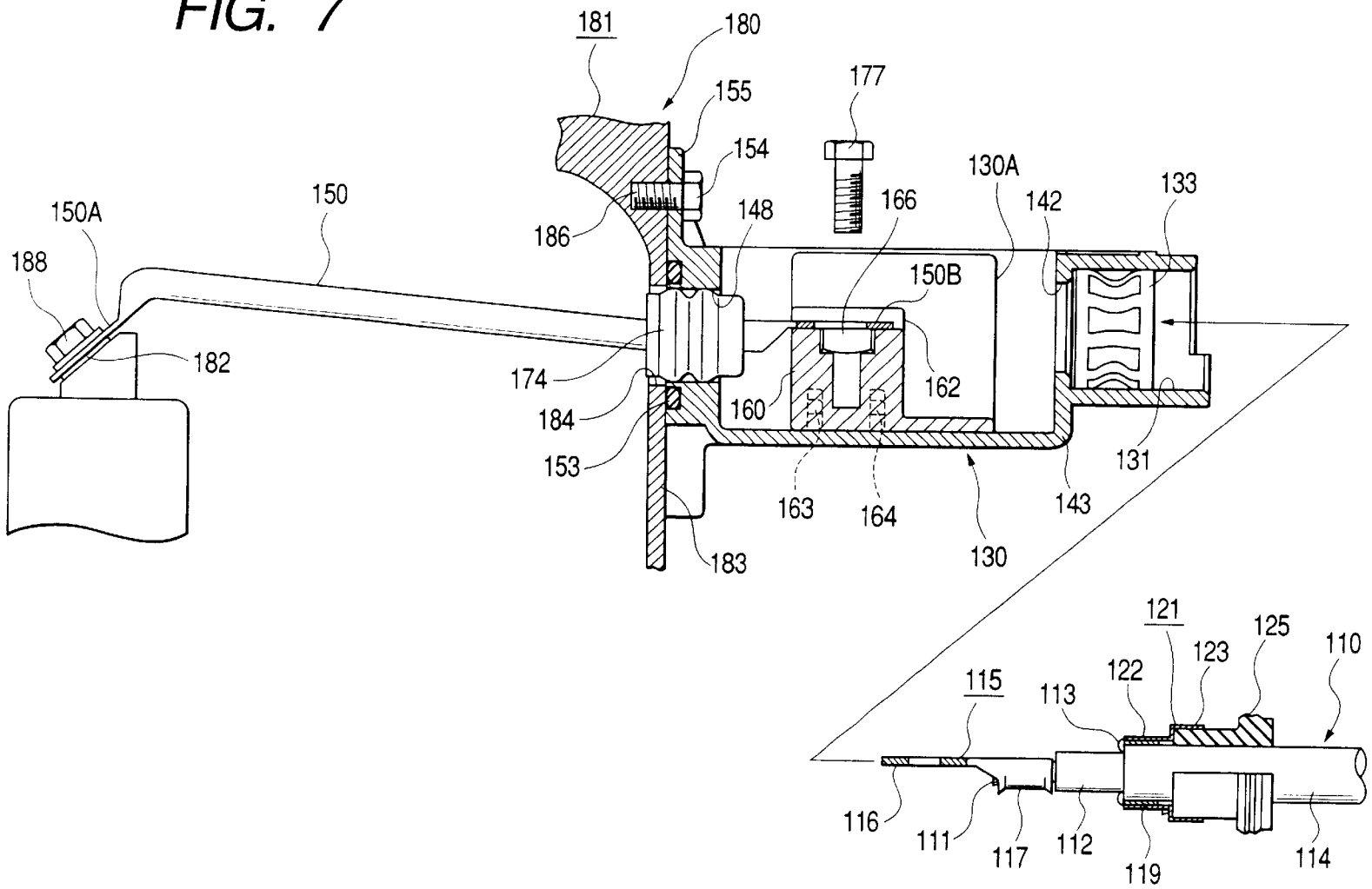
FIG. 7 is a longitudinal sectional view showing the connecting operation of a terminal of a motor cable according to a third embodiment of the invention.

In FIG. 7, a motor 180 comprises a metallic case 181. Three stator terminals 182 are arranged in the motor case 181 in directions of a surface and a back of a paper, and a fixing wall 183 for fixing a shield case 130 to be described below is set through a predetermined longitudinal wall of the motor case 181. Each stator terminal 182 is provided obliquely upward to be turned against the fixing wall 183, and an oblong fixing hole 184 is opened in the fixing wall 183 on almost the same level with the stator terminal 182.

Figure 8:
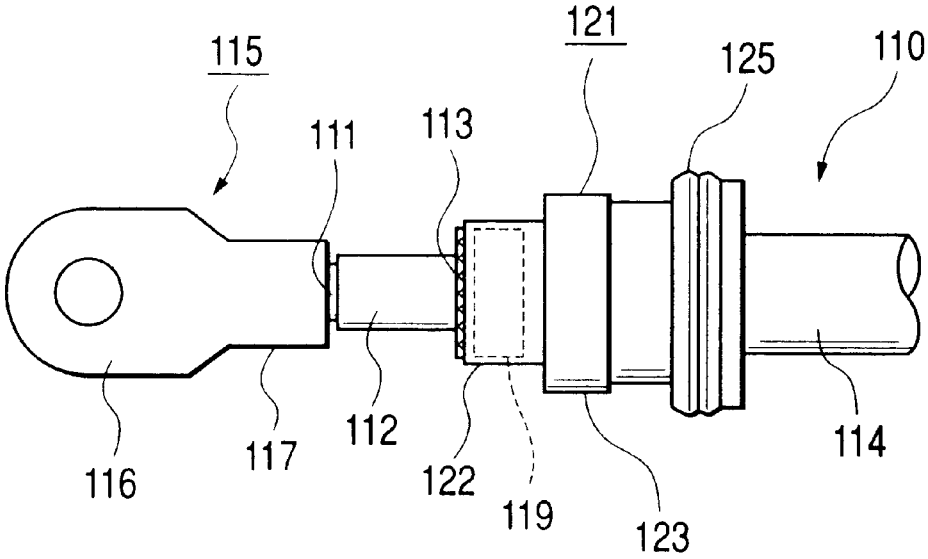
FIG. 8 is a plan view showing the terminal of the motor cable.

A motor cable 110 is a shielding electric wire, and sequentially comprises a core 111, an internal insulating layer 112, a shield layer 113 formed of a braided wire, and an external coat 114 from the axis side as shown in FIGS. 7 and 8, and has the core 111, the internal insulating layer 112 and the shield layer 113 sequentially exposed at a terminal thereof.

A terminal fixture 115 having an eye-ball shaped connecting portion 116 is fastened to a terminal of the core 111 by caulking a barrel 117. On the other hand, an underlying C ring 119 is fitted in a terminal of the external coating 114 and a terminal of the shield layer 113 is wounded and superposed on the C ring 119, and a cylindrical stepped shield shell 121 having a large diameter on the rear end side is provided, and a small diameter portion 122 thereof is caulked and fastened with the terminal of the wound shield layer 113 interposed together with the C ring 119. Moreover, a waterproof rubber plug 125 is pressed by the large diameter portion 123 and is fitted behind the shield shell 121.

Figure 9:
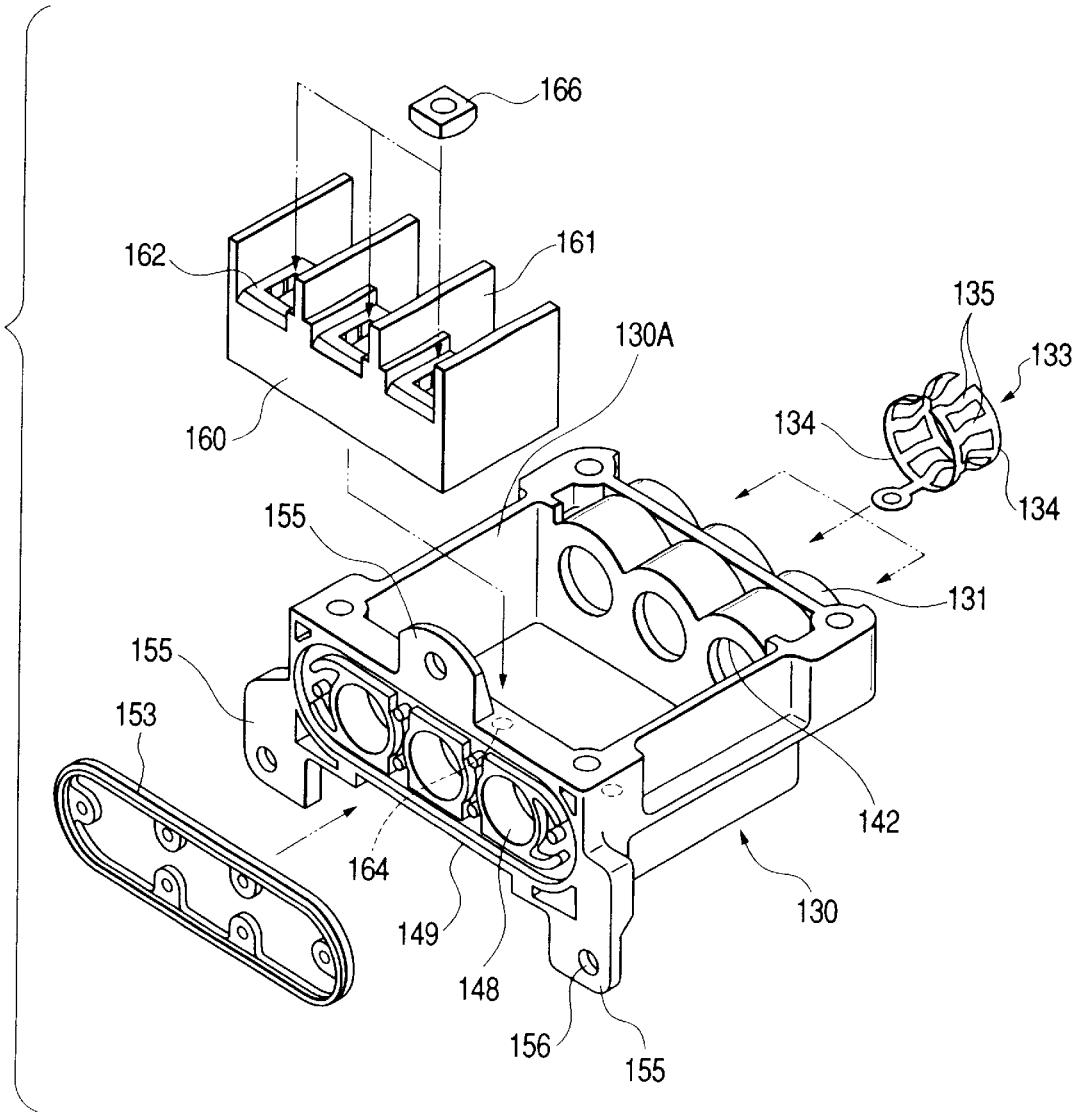
FIG. 9 is an exploded perspective view showing a shield case.
Figure 10:
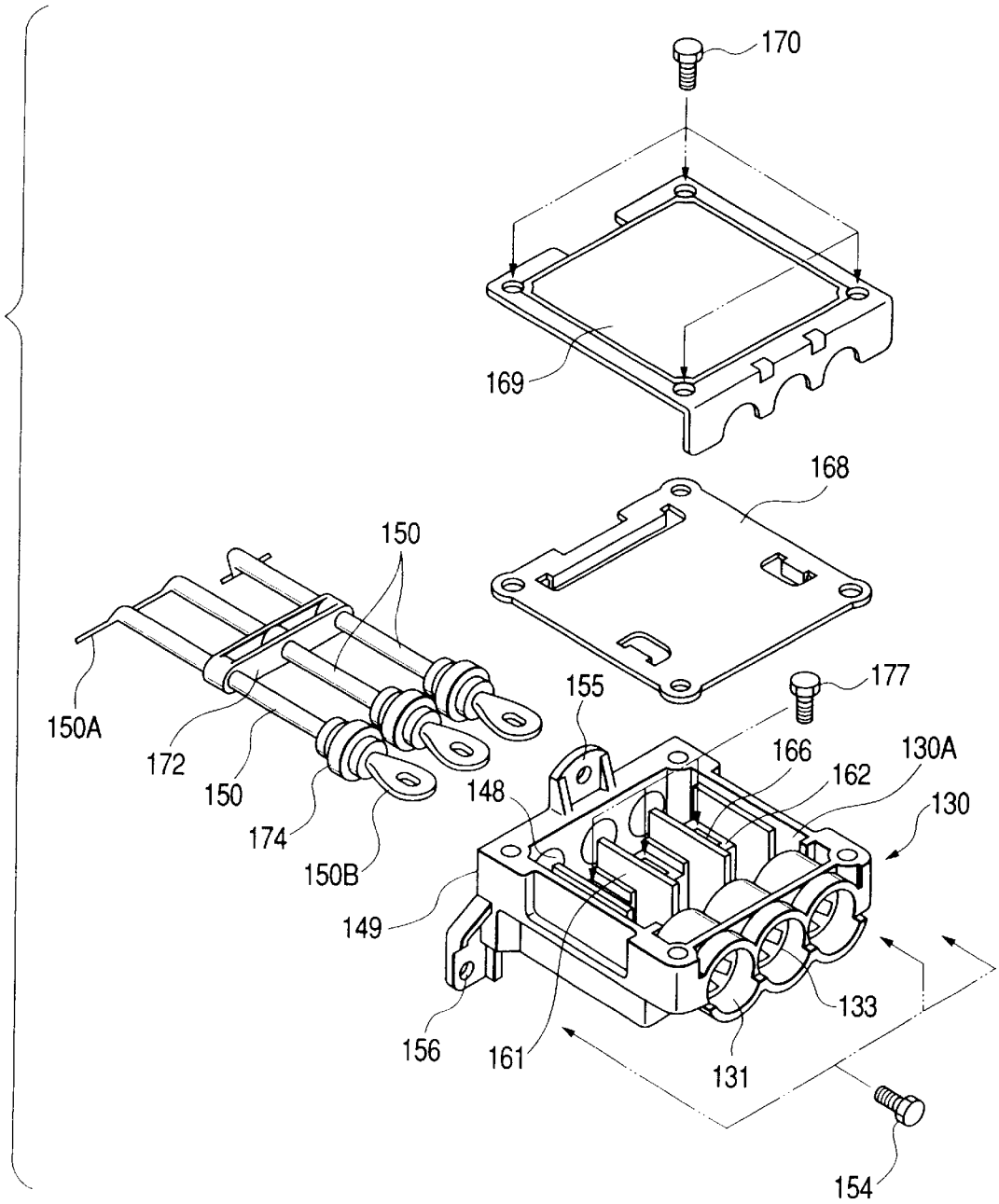
FIG. 10 is an exploded perspective view showing the connecting structure of the shield case to the other's bus bar.

As described above, three motor cables 110 subjected to a terminal processing are provided and the terminals thereof are accommodated in the shield case 103. The shield case 130 is formed of aluminum die casting and wholly takes the shape of a shallow square box having an opening 130A provided on an upper surface as shown in FIGS. 9 and 10.

The shield case 130 has three cylindrical inserting portions 131 arranged in a transverse direction on one of four side surfaces thereof, and the terminal fixture 115 of the motor cable 110 is inserted into each of the inserting portions 131.

A contact 133 is attached into the inserting portions 131, respectively. As shown in FIG. 9, the contact 133 is formed by providing a plurality of bands 135 between to side members 134 at an interval and turning and bending them to have a cylindrical shape which can be tightly fitted in the inserting portion 131, and bulging each of the bands 135 toward the inside like a double enveloping shape.

On the other hand, an internal opening 142 of each inserting portion 131 has a diameter reduced such that the front edge of the contact 133 can hit thereon as shown in FIG. 7.

Three circular penetrating portions 148 are formed opposite to each inserting portion 131 on a surface opposed to a surface provided with the inserting portion 131 in the shield case 130. A bus bar 150 to be connected to the stator terminal 132 of the motor 180 can be inserted into each penetrating portion 148.

Three bus bars 150 are arranged and coupled through a coupling member 172 as shown in FIG. 10, and each of the bus bars 150 has an oblique connecting portion 150A to be connected to the stator terminal 182 formed on one of end sides and a straight connecting portion 150B to be connected to the terminal fixture 115 of the terminal of the motor cable 110 formed on the other end side. A rubber plug 174 capable of being tightly fitted in the penetrating portion 148 is fitted and fixed immediately behind the connecting portion 150B.

A surface 149 on which the penetrating portion 148 is formed can be fixed in contact with the fixing wall 183 of the motor case 181, and a packing 153 is attached to the back side of the fixing surface 149. In addition, a fixing leg 155 having an inserting hole 156 for a bolt 154 formed thereon is protruded from the central portion of an upper edge and both ends of a lower edge, respectively.

A terminal board 160 formed of a synthetic resin is attached into the shield case 130. Three mounting surfaces 162 are partitioned and formed through a partition wall 161 in the terminal board 160. The terminal board 160 is fixed by pressing a pin 164 erected from the bottom face of the shield case 130 into the fixing hole 163 formed on the lower surface of the terminal board 160 as shown in FIG. 7. At this time, each of the mounting surfaces 162 is positioned between the inserting portion 131 and the penetrating portion 148 which are opposed to each other. The connecting portion 150B formed on the other end of the bus bar 150 and the connecting portion 116 of the terminal fixture 115 fastened to the terminal of the motor cable 110 can be superposed and mounted on the mounting surface 162, and furthermore, a square nut 166 is fitted in the mounting surface 162.

Furthermore, the opening 130A formed on the upper surface of the shield case 130 is covered with a metallic cover 169 through the packing 168 and four corners of the cover 169 are fastened with a bolt 170.

Subsequently, description will be given to an example of the assembling procedure according to the embodiment.

In the shield case 130, the contact 133 is inserted from the outside into each inserting portion 131 and is caused to hit on the edge of the internal opening 142 and is thus maintained. Moreover, the terminal board 160 having the square nut 166 attached to each mounting surface 162 is assembled into the shield case 130, and the packing 153 is attached to the fixing surface 149. Then, each of the connecting portions 150B of the three bus bars 150 arranged and coupled through the coupling member 172 is inserted from the outside into each penetrating portion 148, and is mounted on the mounting surface 162 corresponding to the terminal board 160. In addition, the rubber plug 174 provided behind the connecting portion 150B is tightly fitted and attached into the penetrating portion 148.

The shield case 130 thus assembled is previously fixed to the motor case 181. More specifically, as shown in FIG. 7, the fixing surface 149 is caused to hit on the fixing wall 83 of the motor case 181 while the connecting portion 150A provided opposite to the bus bar 150 is inserted into the fixing hole 184, and the bolt 154 inserted through the inserting holes 156 of the fixing legs 155 provided in three parts is screwed and fastened to a screw hole 186 threaded into a predetermined position around the fixing hole 184. Consequently, the shield case 130 is fixed to be protruded horizontally with respect to the motor case 181 with the packing 153 compressed. Moreover, the connecting portion 150A plunged into the motor case 181 of the bus bar 150 is connected, with a bolt 188, to the stator terminal 182 corresponding to the motor 180.

Figure 11:
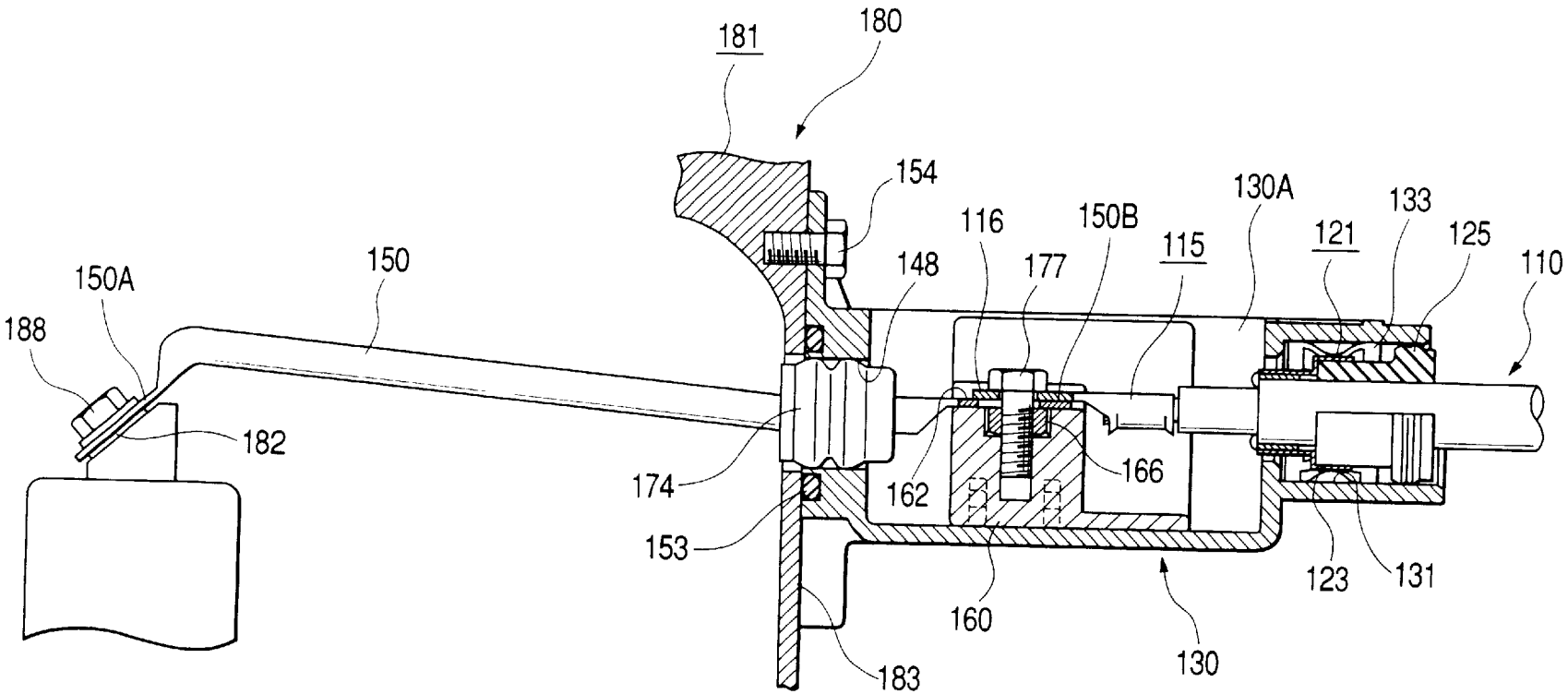
FIG. 11 is a longitudinal sectional view showing a state in which the motor cable and the bus bar are connected to each other.

In the case in which the motor cable 110 is to be connected, the terminal fixture 115 provided on the terminal of each motor cable 110 is inserted into the corresponding inserting portion 131 in the above state as shown in an arrow of FIG. 7. The connecting portion 116 of the terminal fixture 115 reaches the mounting surface 162 of the terminal board 160 and is then inserted to be superposed on the connecting portion 150B of the bus bar 150. Then, when the bolt 177 is inserted into the connecting portions 116 and 150B of the terminal fixture 115 and the bus bar 150 to be screwed and fastened to the square nut 166, the terminal fixture 115 and the bus bar 150 corresponding thereto are connected to each other and are fixed to the terminal board 160 as shown in FIG. 11.

At this time, the large diameter portion 123 of the shield shell 121 is fitted into the inner peripheral surface bulged in the contact 133 and elastically comes in contact therewith, and moreover, the waterproof rubber plug 125 is tightly fitted and attached into the entry of the inserting portion 131.

When the three motor cables 110 are completely fixed, the cover 169 is put on the opening 130A formed on the upper surface of the shield case 130 through the packing 168 and four corners thereof are fastened with the bolt 170 to close the cover 169.

As described above, the terminal of each motor cable 110 is connected to the stator terminal 182 of the corresponding motor 180 through the bus bar 150. At this time, the shield case 130 is set in an electrical connection state with the grounded metallic motor case 181, and the periphery from the terminal fixture 115 of the terminal of the motor cable 110 to the bus bar 150 is completely surrounded by the inserting portion 131, the shield case 130, the cover 169, and furthermore, the motor case 181 without a clearance. Consequently, it is possible to reliably prevent the invasion of a noise into the motor cable 110 or the leakage of the noise.

In the case in which the motor cable 110 is to be removed for maintenance, the bolt 170 is loosened to remove the cover 169. Consequently, the terminal board 160 portion is exposed upward. Therefore, when the bolt 177 is loosened and pulled out, the fixation of the terminal fixture 115 can be released. Subsequently, when the motor cable 110 is pulled rearward, the terminal of the motor cable 110 can be pulled out of the shield case 130 while the terminal fixture 115 passes through the inserting portion 131.

In the embodiment, as described above, the shield case 130 is previously fixed to the motor case 181 to cause the other end of the bus bar 150 connected to the stator terminal 182 to face the terminal board 160 in the shield case 130, and the terminal fixture 115 of the motor cable 110 is connected to the bus bar 150 in the terminal board 160. In other words, the motor cable 110 can be connected to the stator terminal 182 later. Therefore, the motor cable 110 can be circulated separately from the motor 180, and furthermore, the time the work for connecting the motor cable 110 is to be carried out can also be incorporated comparatively freely.

Moreover, when the cover 169 is removed and the bolt 177 is loosened to release the fixation of the terminal fixture 115, the motor cable 110 can be simply taken out with the motor 180 and the shield case 130 maintained in that state, and can be exchanged easily.

Furthermore, in the case in which the motor case 181 is to be used as an oil chamber, an expensive electric wire excellent in oil-resistance is required if the electric wire is used for a conducting path provided from the stator terminal 182 into the shield case 130. In the embodiment, the bus bar 150 is utilized for the conducting path. By simply attaching the packing 153 between the shield case 130 and the motor case 181 and fitting the rubber plug 174 in the penetrating portion 148 of the shield case 130, therefore, a countermeasure against oil can be taken comparatively inexpensively.

<Fourth Embodiment>

Figure 12:
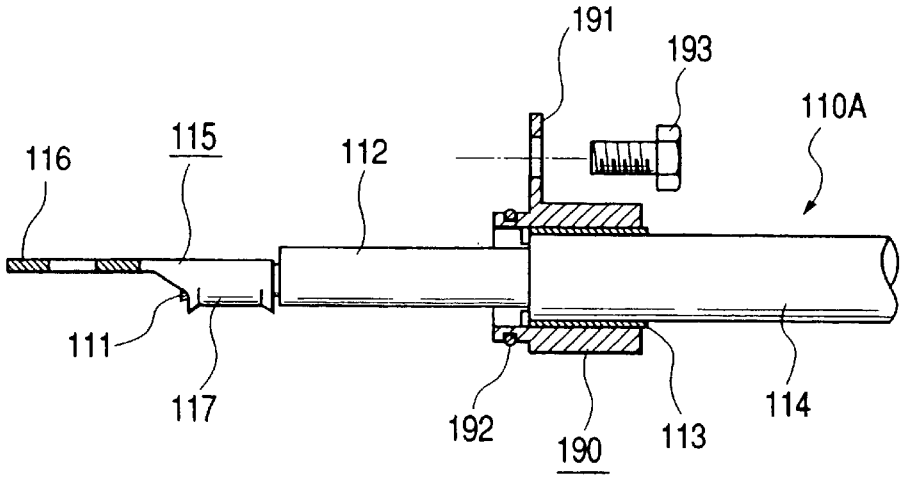
FIG. 12 is a side view with apart thereof cut away, showing the terminal structure of a motor cable according to a fourth embodiment.
Figure 13:
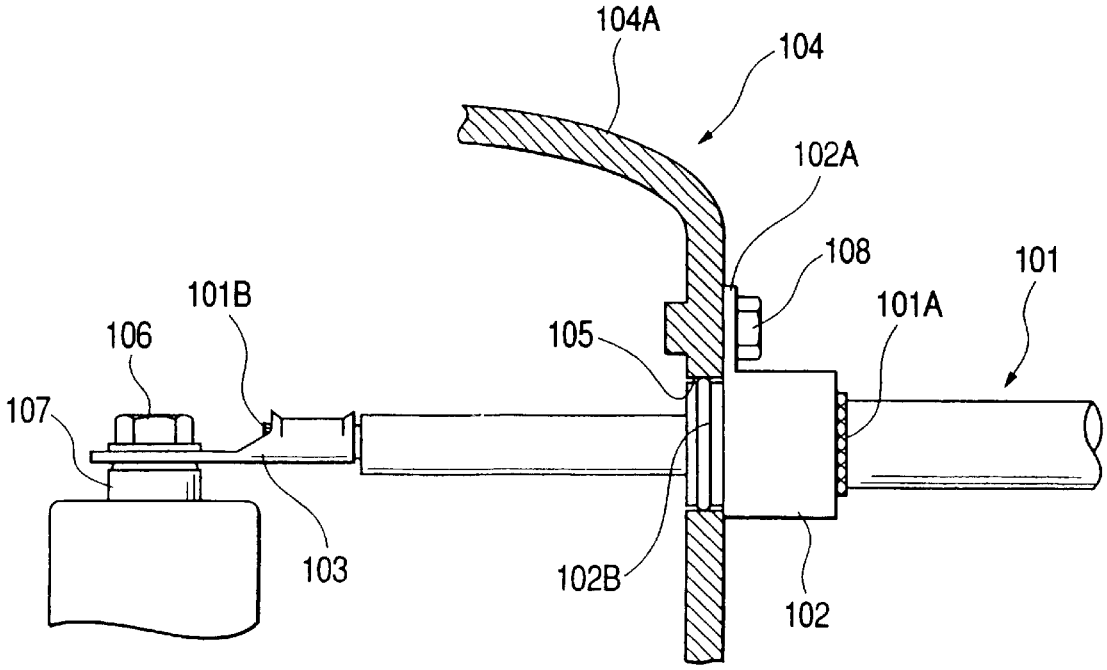
FIG. 13 PRIOR ART
FIG. 13 is a sectional view showing a conventional example.

FIG. 12 shows a fourth embodiment of the invention. As described above, the terminal of the motor cable serves to carry out a conducting processing and a waterproof processing for an electromagnetic shield on the shield case. The shape of the shield case can be changed more easily than that of the motor case. Therefore, the terminal structure of the motor cable can easily have a variation.

The fourth embodiment is illustrative, and particularly, the shape of a shield shell 190 and a fixing structure thereof are changed.

More specifically, the shield shell 190 is formed to have a stepped cylindrical shape in which the outer periphery of a front end is thin. A ground portion 191 is bulged from the outer periphery of the stepped portion and a seal ring 192 is fitted on the front end side. The rear end side of the shield shell 190 is covered and fitted onto the outer periphery of the terminal of a wound shield layer 113.

In a motor cable 110A subjected to a terminal processing, thus, a terminal fixture 115 is inserted into a shield case (not shown) through an inserting portion and the seal ring 192 is tightly fitted in the inner periphery of the inserting portion so that waterproof can be obtained. Moreover, the ground portion 191 is fastened to the shield case with a bolt 193 to take a ground. Thus, electromagnetic shielding can be achieved.

<Other Embodiment>

The invention is not restricted to the embodiments described above with reference to the drawings but the following embodiments are also included in the technical range of the invention, for example. Furthermore, various changes can be made without departing from the scope of the invention.

(4) A coated electric wire may be used for a conducting path pulled from a stator terminal into a shield case, which is also included in the technical range of the invention.

(5) The invention can be widely applied to the general case in which a terminal of a shielding electric wire is connected to a terminal provided in an apparatus as well as the case in which a terminal of a motor cable is connected to a stator terminal of a motor.

What is claimed is:

1. A shield connector comprising:

a cylindrical housing portion formed of an aluminum die cast, a contact being fitted and attached into said housing portion, and a shield member provided on a terminal of a shielding electric wire being caused to elastically come in contact with said contact, wherein said contact is fixed to said aluminum housing portion with a bolt, wherein said bolt provides electrical connection between said contact and said aluminum housing portion.

2. The shield connector according to claim 1, wherein said contact is elastically deformable and cylindrical so that said shield member of said terminal of said shielding electric wire is capable to be fitted into said contact, and said contact includes a fixing portion extended from an edge in an axial direction thereof, said fixing portion being provided with an inserting hole for inserting said bolt to be screwed to a screw hole threaded in said housing portion.

3. A terminal connecting device for a shielding electric wire which serves to connect a terminal of a shielding electric wire to a terminal provided in an apparatus, the terminal connecting device comprising:

a shield case is fixed to an outer surface of said apparatus, one end of a conducting path having a connection to said terminal provided in said apparatus, said terminal of said shielding electric wire is inserted into an inserting portion formed on a side surface of said shield case so that a shield member provided on said terminal comes in contact with said inserting portion, and a terminal of a core of said shielding electric wire and an other end of said conducting path are coupled to each other on an insulating terminal board provided within said shield case.

4. The terminal connecting device for a shielding electric wire according to claim 3, wherein an operation opening is formed on a side surface corresponding to an outside of a portion in said shield case where said terminal board is provided, and a cover is removably put over the operation opening.

5. The terminal connecting device for a shielding electric wire according to claim 3, wherein said conducting path is formed of a bus bar.

6. The terminal connecting device for a shielding electric wire according to claim 4, wherein said conducting path is formed of a bus bar.

* * * * *